US007469850B2

(12) United States Patent
Lipowski et al.

(10) Patent No.: US 7,469,850 B2
(45) Date of Patent: Dec. 30, 2008

(54) COMMINUTING APPARATUS WITH THREE-PHASE SYNCHRONOUS MOTOR AND INTEGRATED EPICYCLIC GEAR STAGE

(75) Inventors: Wolfgang Lipowski, Seck (DE); Thomas Sturm, Zehnhausen (DE); Jochen Giehl, Niederroβbach (DE)

(73) Assignee: VECOPLAN Maschinenfabrik GmbH & Co. KG, Bad Marienberg (DE)

( * ) Notice: Subject to any disclaimer, the term of this patent is extended or adjusted under 35 U.S.C. 154(b) by 387 days.

(21) Appl. No.: 11/461,076

(22) Filed: Jul. 31, 2006

(65) Prior Publication Data

US 2008/0223966 A1 Sep. 18, 2008

(30) Foreign Application Priority Data

Aug. 5, 2005 (DE) ..... 10 2005 037 668

(51) Int. Cl.
*B02C 19/00* (2006.01)

(52) U.S. Cl. ..... 241/101.2; 241/242

(58) Field of Classification Search ..... 241/242, 241/101.2

See application file for complete search history.

(56) References Cited

U.S. PATENT DOCUMENTS 4,545,539 A * 10/1985 Steffensen ..... 241/73
7,168,640 B2 * 1/2007 Lipowski ..... 241/36
2007/0164139 A1 * 7/2007 Lipowski et al. ..... 241/101.2

FOREIGN PATENT DOCUMENTS

DE 203 13 327 11/2003
EP 0 419 919 4/1999

OTHER PUBLICATIONS

Office Action Issued by the German Patent Office for Corresponding Application No. DE 10 2005 037 668.1.

* cited by examiner

*Primary Examiner*—Faye Francis
(74) *Attorney, Agent, or Firm*—Alston & Bird LLP

(57) ABSTRACT

A comminuting apparatus having a compact, variable-speed drive unit with a high level of efficiency and high torque levels. The comminuting apparatus comprises a drive device having an electric motor operatively connected by way of a transmission device to a comminuting shaft that has comminuting tools at its periphery. The tools cooperate with a counterpart member to comminute the material to be processed. The electric motor is in the form of a high-pole three-phase synchronous motor that is electrically connected to the output of a frequency converter controlled by a control device, and the transmission device is in the form of an epicyclic transmission device. The motor surrounds the epicyclic transmission device at least in part, and the motor and the transmission device are arranged in a common housing.

16 Claims, 5 Drawing Sheets a)

a)

b)

a)

c)

b)

a)

COMMINUTING APPARATUS WITH THREE-PHASE SYNCHRONOUS MOTOR AND INTEGRATED EPICYCLIC GEAR STAGE

FIELD OF THE INVENTION

The invention concerns a comminuting apparatus for waste and/or production residues.

The term waste will be used hereinafter in this specification in a broad sense to embrace both waste from various processes as well as production residues, as appropriate.

BACKGROUND OF THE INVENTION

Such a comminuting apparatus may be used for example for comminuting wood, paper, plastic material, rubber, textiles, production residues or waste from trade and industry, but also bulky refuse, domestic refuse, paper collections and collections from waste-disposal organisations as well as hospital wastes, etc. A comminuting apparatus for such a purpose may comprise at least one drive unit having an electric motor which is operatively connected by way of a transmission device to a comminuting shaft which at its periphery has comminuting tools, the comminuting tools being co-operable with a counterpart member for comminuting the material to be processed. In that situation the material to be processed is comminuted by cutting, shearing, squeezing, tearing and/or rubbing between rotor members or in the cooperation between a rotor member and a stationary transverse member associated therewith. Such an apparatus is described for example in EP 0 419 919 B1. In addition a comminuting apparatus for such a process may comprise a plurality of rotor members with respective stationary transverse members associated therewith, between the rotor members.

Various drive concepts are known for such comminuting apparatuses. The apparatus can include for example an asynchronous motor which operates at a motor speed of about 1500 revolutions per minute at a mains frequency of 50 Hz. To set the specified speed of rotation of the comminuting shaft, the transmission of force is effected by way of a belt drive or a universally joined shaft or a clutch to the transmission in which the rotary speed is reduced to between about 50 and 200 rpm, depending on the respective demands involved. By virtue of the high transmission ratio required it is possible to use transmissions with a plurality of successive transmission stages, which reduces the level of efficiency of such apparatuses. Furthermore such apparatuses are very noisy because of the number of components of which some are moving at a high rotary speed. In addition the amount of space occupied by such a drive is large because of the different drive members which are connected together. In many cases protective covers or housings are required in order to enclose rotating shafts, clutches or belt drives between the individual units of such a drive arrangement, as may be appropriate from the safety point of view.

A further form of comminuting apparatus uses a hydraulically acting drive substantially comprising a drive motor and a suitable hydraulic pump coupled thereto and connected by way of a hydraulic circuit to a hydraulic motor which drives the comminuting shaft either by means of a step-down transmission or without a transmission. That variant is very costly and maintenance-intensive and comparatively disadvantageous in terms of efficiency. On the other hand that concept affords the advantage that the rotary speed of the comminuting shaft is adjustable over a predetermined range. The use of hydraulic drives however suffers from the disadvantage of poor efficiency and loud operating noise. Furthermore heavily loaded hydrostatic systems are maintenance-intensive by virtue of the leakages, which have been found in practice to occur in permanent operation, at the large number of connections between the individual components.

SUMMARY OF THE INVENTION

An object of the invention is to provide a comminuting apparatus having a compact, variable-speed drive unit which has a high level of efficiency and which in addition can produce high levels of torque for comminuting the material to be processed.

A further object of the invention is to provide a waste comminuting apparatus which affords a high degree of operational adjustability and thus versatility in operation.

Yet another object of the invention is to provide a drive unit for a waste comminuting apparatus, which can be compact and simple in structure, reliable in operation, and capable of meeting the demands made thereon in an efficient and flexible fashion.

The foregoing and other objects are attained by the invention set forth herein.

In accordance with the principles of the invention a comminuting apparatus for waste and/or production residues comprises at least one drive unit having an electric motor operatively connected by way of a transmission device to a comminuting shaft which at its periphery has comminuting tools, wherein the comminuting tools are co-operable with a counterpart member for comminuting the material to be processed. The electric motor is in the form of a high-pole three-phase synchronous motor that is electrically connected to the output of a frequency converter controlled by a control device. The transmission device is in the form of an epicyclic transmission device, wherein the three-phase synchronous motor surrounds the epicyclic transmission device at least in part, and the motor and the transmission device are arranged in a common housing.

As will be seen from the following description of configurations according to an advantageous embodiment of the comminuting apparatus according to the invention, in relation to the control, the use of a synchronous motor in conjunction with a frequency converter connected upstream thereof makes it possible to produce a high level of torque over the entire rotary speed range, whereby for example the start-up phase can be facilitated or the apparatus can also be started under load. By virtue of the use of the epicyclic transmission device, the torque of the drive unit, which is already very high in the case of a high-pole three-phase synchronous motor (which can also be referred to as a torque motor), can be further increased. In addition the drive unit in the comminuting apparatus according to the invention can be of a particularly compact structure as the epicyclic transmission device is at least partially accommodated by the three-phase synchronous motor, with the motor and the transmission arranged in a common housing.

It will be further appreciated that the invention is based on the idea of coupling a rotary speed-variable synchronous motor by way of a planetary gear device, which is preferably of a one-stage configuration, to a comminuting shaft so that it is possible to provide a comminuting machine having a very high level of efficiency. The use of a high-pole three-phase synchronous motor means that the basic rotary speed of the motor is relatively low so that a single-stage planetary transmission is already generally sufficient to step down the basic rotary speed of the comminuting shaft to the necessary extent. A synchronous motor of that kind can have for example a level of efficiency of about 92%, and a single-stage planetary transmission of about 98%, so that ultimately, for the specified example, the level of efficiency of the overall drive unit is about 90%.

The comminuting apparatus according to the invention can be flexibly adapted to the respective requirements involved. In an advantageous embodiment it is possible for the mass center of gravity of the entire drive unit to be arranged close to the comminuting shaft so that this arrangement affords a particularly high level of smoothness of operation of the drive unit, by virtue of the short force lever caused thereby. The compactness of the drive unit, in an embodiment of the invention, also means that it is possible for it to be fitted directly onto the comminuting shaft so that the number of necessary bearings is reduced in comparison with a successive arrangement of a motor and a plurality of drive units.

A three-phase synchronous motor used for the drive of the apparatus according to the invention has a large number of poles to provide a high level of torque and to afford a low basic speed. Three-phase synchronous motors with more than 8 poles, still more advantageously more than 16 poles, extremely advantageously more than 22 poles, can preferably be used. The numbers of poles of the synchronous motor, which are specified as advantageous, apply in particular in relation to a mains frequency of 50 Hz.

Further advantageous embodiments of the invention are recited in the appendant claims.

It can be appropriate if the epicyclic transmission device includes at least one sun wheel, an annulus and a plurality of planet wheels. In particular the epicyclic transmission device can be a one-stage planetary transmission which, with a suitable construction, affords the possibility of a completely symmetrical arrangement of all components in relation to the main axis of rotation and thus no unbalances occur in operation at the comminuting machine according to the invention. In particular the transmission device of such a configuration in the comminuting apparatus according to the invention also manages without any problem the jerk and shock loadings which usually occur with such apparatuses. Depending on the respective three-phase synchronous motor used it may be desirable to use an epicyclic transmission device with a step-down ratio of between 1:2 and 1:10, whereby the rotary speed of the motor can be reduced for the shaft by the corresponding factor and in addition the torque at the comminuting shaft is correspondingly increased. In principle and in accordance with the invention it is also possible to use multi-stage epicyclic transmission devices, which however involves a higher level of structural complication and expenditure and is generally not necessary by virtue of the variable-speed three-phase synchronous motor. Synchronous motors used with the comminuting apparatus according to the invention have a typical rotary speed of between about 0 and 700 rpm, particularly typically between about 0 and 400 rpm, so that the rotary speed of the driven comminuting shaft is in a range of between about 0 and 200 rpm, particularly typically between about 0 and 100 rpm. In principle however it is also possible to use three-phase synchronous motors with even higher rotary speeds for the drive unit of the comminuting apparatus according to the invention. The torque of the motors is for example between about 1 kNm and about 10 kNm.

In principle any shaft of the epicyclic transmission device can be used as the drive input or drive output shaft. It has proven to be particularly advantageous however if the arm carrier shaft, which can also be referred to as the planet wheel carrier shaft, of the epicyclic transmission device is used as the drive output shaft, to which the comminuting shaft of the comminuting apparatus is coupled. In this case the arm carrier shaft can project out of the common housing of the motor and the transmission and can be coupled outside the housing to the comminuting shaft. On the other hand however it is also possible for the comminuting shaft to be coupled to the drive output shaft of the transmission, within the common housing of the motor and the transmission.

For the purposes of coupling the arm carrier shaft to the comminuting shaft, the arm carrier shaft in that case can be for example in the form of a hollow shaft or also in the form of a shaft journal or trunnion, in which case the comminuting shaft can be of a complementary configuration thereto in the coupling region.

It may be desirable if the axis of the sun wheel and/or the annulus of the epicyclic transmission device lies or lie on the axis of the synchronous motor. That provides on the one hand a compact structure for the drive unit and also a symmetrical arrangement around the axis of the motor, whereby it is possible to avoid unbalances in the drive unit.

In another preferred configuration it may be desirable if the sun wheel is covered at least in portion-wise manner over the axial extent thereof by radially outwardly disposed motor windings of the synchronous motor. In that case the planetary transmission of the comminuting apparatus according to the invention is disposed radially inwardly with respect to the motor, which ultimately leads to the drive unit of the comminuting apparatus according to the invention being of a highly compact structure. In the same manner the annulus can be covered at least in portion-wise fashion over the axial extent thereof by radially outwardly disposed motor windings of the synchronous motor. It is particularly advantageous if substantially the entire planetary transmission is arranged radially inwardly in the motor, over the axial extent of the planetary transmission, so that no further space or scarcely any additional space has to be made available for the provision of the epicyclic transmission device.

In another preferred configuration both the three-phase synchronous motor which is used in the comminuting apparatus according to the invention and also the associated epicyclic transmission device can be cooled for the dissipation of operating heat. For that purpose it is possible to provide a fluid coolant circuit in which at the primary side the circulating cooling fluid flows through a heat exchanger, the secondary-side heat exchange surface of which is in turn cooled by air or water. In an embodiment which may be particularly appropriate the cooling circuits of the synchronous motor and the epicyclic transmission device are coupled together and have a common heat exchanger, wherein the circulating coolant used can be the lubricating oil of the epicyclic transmission device, whereby the structural complication and expenditure for cooling purposes is considerably reduced.

In principle the comminuting apparatus according to the invention can have a three-phase electric motor in which the rotor is arranged radially outwardly or radially inwardly relative to the stator. In the former embodiment more space can be provided for the epicyclic transmission device which is disposed inwardly relative to the stator. The latter embodiment has the advantage over the first embodiment that the entire drive unit is of a small extent in the radial direction. The magnetic field arrangement of the rotor can be afforded by means of permanent magnets but also by a suitable coil device which is supplied with a direct current.

It may be desirable for the function of the rotor of the synchronous motor and the function of the annulus of the epicyclic transmission device to be integrated into a component unit of the drive. In this embodiment the gear device of the annulus is rigidly connected to the rotor of the synchronous motor, that is to say the annulus of the epicyclic transmission device rotates with the rotor. By way of example the comminuting apparatus according to the invention can include a component unit in the form of a hollow cylinder, which at the radial outside surface has a magnet device of the synchronous motor to provide the rotor function, wherein at least one gear device of the epicyclic transmission device is arranged at the radial inside surface of the component unit, for providing the configuration of the annulus. It will be appreciated that the hollow-cylindrical component does not have to be made in one piece but can comprise a plurality of elements. It is essential in that respect that the magnet device, that is to say the coil or the permanent magnets, is or are rigidly connected to the gear arrangement of the annulus.

In a further preferred feature the rotor of the synchronous motor may be connected to the sun wheel rigidly or by means of a releasable coupling device. In that respect it can also be provided that the stator of the synchronous motor, the common housing of the synchronous motor and the transmission and the annulus of the epicyclic transmission device are rigidly connected together. If in this embodiment the sun wheel is connected to the rotor of the synchronous motor, the arm carrier shaft of the planet wheels acts as the drive output shaft of the transmission device.

The compact design configuration of the drive unit of the comminuting apparatus according to the invention means that the connection of the drive unit to the comminuting shaft can be such that the entire drive unit comprising the three-phase synchronous motor and the epicyclic transmission device is completely carried and supported by the comminuting shaft.

In order for the reaction torque during operation of the apparatus to be absorbed, a preferred feature can provide that the drive unit is connected by way of a torque support means to an external absorption point such as the housing of the comminuting apparatus.

The invention can be used for a large number of differing designs of comminuting apparatuses. That involves for example comminuting apparatuses with a single comminuting shaft which for example is supported at the two ends thereof, wherein a drive unit is fitted thereonto or flange-mounted thereto at one end, as already described above. Furthermore it can also be provided that a respective drive unit of that kind comprising a high-pole three-phase synchronous motor with integrated planetary transmission device is coupled to both ends of a single comminuting shaft, in which case the control device actuates the two motors in the same way by way of the frequency converter. The counterpart member used can be for example a one-piece transverse blade member which is stationary relative to the comminuting tools mounted on the comminuting shaft, or also a plurality of counterpart blade members which are stationary relative to the comminuting tools mounted on the comminuting shaft, for cooperation with the comminuting tools. The invention can also be applied to comminuting apparatuses which have two or even more comminuting shafts, in which case an individual shaft can in turn include two or more drive units.

Furthermore instead of a stationary counterpart member it is also possible to provide a movable counterpart member for the comminuting tools on a comminuting shaft. For example the counterpart member can be resiliently supported for example by means of a spring device so that, when unusually high forces occur, the counterpart member can deflect relative to the comminuting tools, whereby in many cases damage to the apparatus can be avoided. Furthermore it is for example also possible to use as the counterpart member for a comminuting shaft, an adjacent comminuting shaft, so that the adjacent comminuting shafts each mutually provide the respective counterpart member for processing the material to be processed.

Further objects, features and advantages of the invention will be apparent from the description hereinafter of preferred embodiments of the invention.

DESCRIPTION OF PREFERRED EMBODIMENTS

Figure 1:
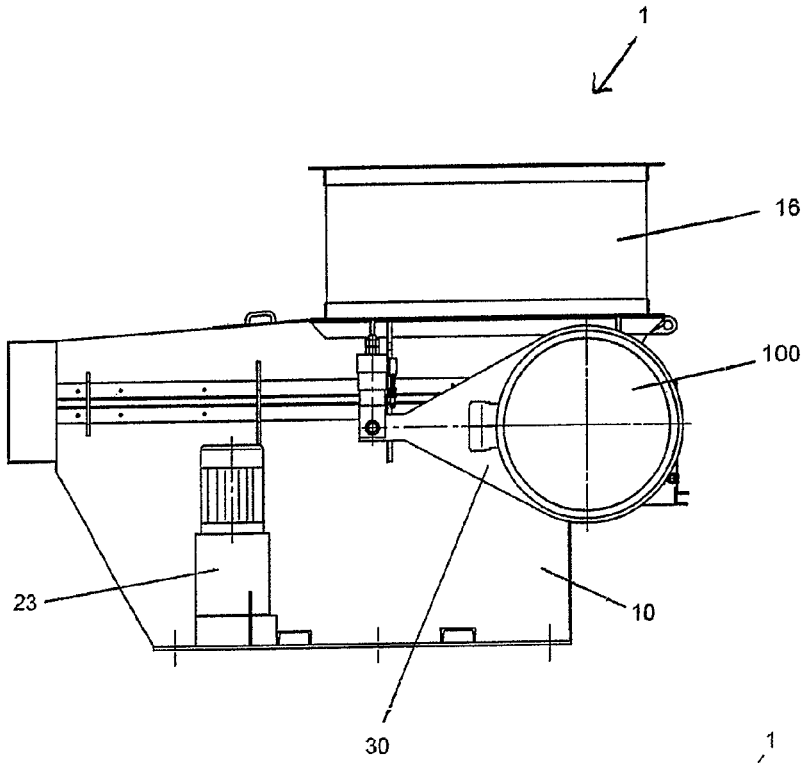
FIG. 1*a* shows a plan view of a comminuting apparatus according to the invention equipped with a drive unit as also shown in FIGS. 1 and 2 respectively.
FIG. 1*b* shows a side view of the comminuting apparatus shown in FIG. 3*a*.
FIG. 1*c* shows a front view of the comminuting apparatus shown in FIG. 3*a*.
Figure 1:
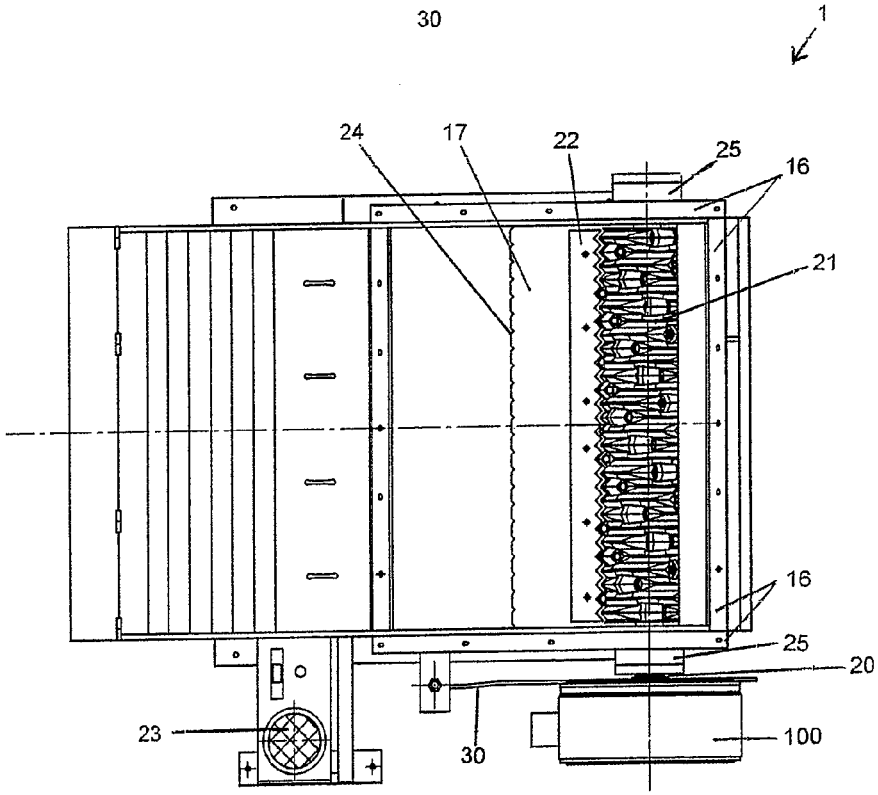
Figure 1:
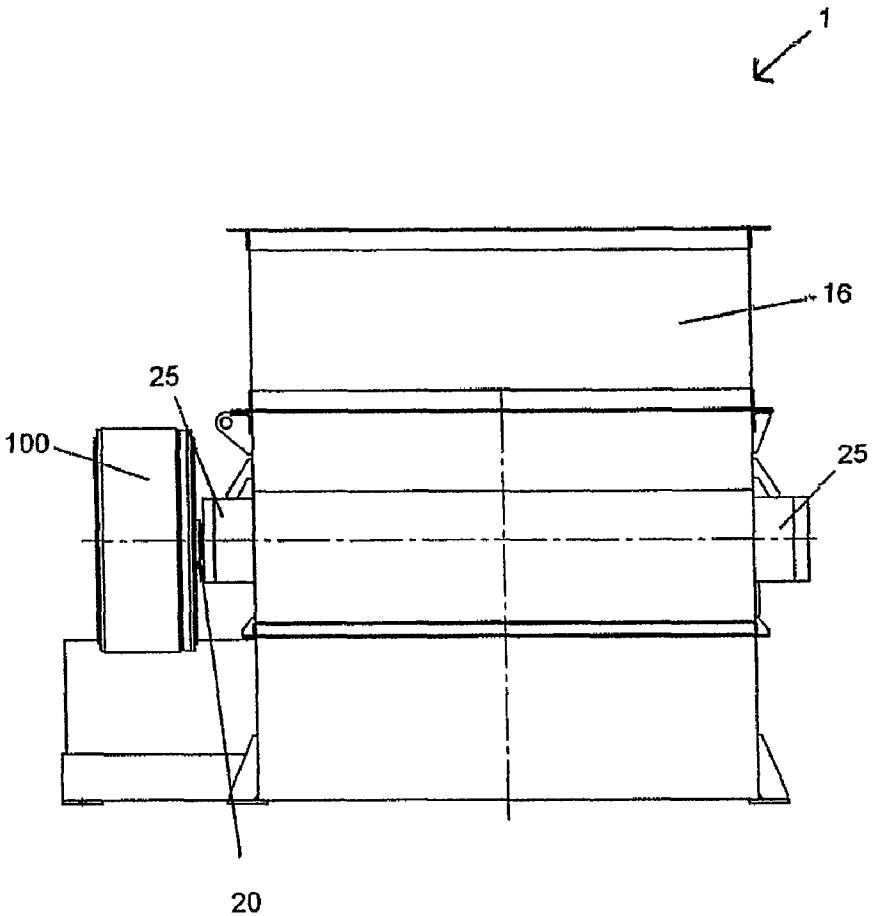

Reference will first be made to FIGS. 1*a* through 1*c* showing a comminuting apparatus 1 according to the invention by way of example, as can be used for example for waste such as wood, paper or plastic materials. It has a housing 10 to which a comminuting shaft 20 is mounted by means of bearings 25, while comminuting tools 21 are arranged at the periphery of the comminuting shaft 20 in axially spaced relationship. A comminuting chamber is defined by a table 17 and wall portions 16. The comminuting tools 21 cooperate with a stationary counterpart member in the form of a transverse blade member 22. Fitted on the comminuting shaft 20 at one end is a drive unit 100 which is supported on the housing 10 by way of a torque support 30. Material to be comminuted falls from above into the comminuting chamber defined by the wall portions 16 on to the table surface 17 and is subsequently fed to the comminuting tools 21 by a slider 24 which is movable horizontally by means of the hydraulic drive 23. After the slider 24 has reached the position which is closest to the comminuting shaft the slider is retracted again, whereby further material to be comminuted drops on to the table 17, and is subsequently moved after reversal of the direction of movement of the slider in the direction of the comminuting shaft. The material to be comminuted falls downwardly with respect to the plan view in FIG. 1*a* and is there collected or transported away, depending on the specific embodiment involved in each case. While FIG. 1*a* shows a plan view of the apparatus, FIG. 1*b* shows a side view of the comminuting apparatus designed in accordance with the invention and FIG. 1*c* shows a front view thereof.

In an embodiment which is not shown the transverse member can also be such that it is stationary only in the case of the forces which occur upon comminution of materials provided, while when those forces are exceeded, for example as a consequence of a foreign body which cannot be comminuted in the feed material, the transverse member can however yield by virtue of an elastic mounting thereof in order to avoid damage to the comminuting tool.

The apparatus shown in FIGS. 1*a* through 1*c* has a drive unit 100 with a high pole, as here a 24-pole, three-phase synchronous motor with integrated planetary transmission device, wherein the drive output shaft of the transmission is in the form of a hollow shaft, onto which the machine shaft formed by the comminuting shaft 20 is pushed. Accordingly no special mounting arrangement is required here for the drive unit which is held and supported by the comminuting shaft. The three-phase synchronous motor which is operated at a variable frequency has an inner rotor with permanent magnets, which rotor in turn accommodates the planetary transmission device in a radially inward position so as to afford the compact structure illustrated in the Figures for the drive unit 100. As the transmission arrangement is accommodated by the synchronous motor at least in part and preferably completely as in this case, the entire drive unit is surrounded by a common housing which, by virtue of the specific design configuration involved, is no larger than the corresponding housing for the synchronous motor. It is not visible in the Figures, but the comminuting apparatus includes a frequency converter which is controlled by a control device and with which the rotary speed of the motor and therewith the machine shaft is controlled. In the described embodiment the one-stage planetary transmission device has a constant step-down ratio of 1:5. As a result the torque of the electric motor which is also referred to as a torque motor is increased by the factor of 5 in comparison with the torque at the drive output shaft of the motor.

The structure in principle of the drive unit 100 of the comminuting apparatus according to the invention as shown in FIGS. 1*a* through 1*c* will be described hereinafter.

Figure 2:
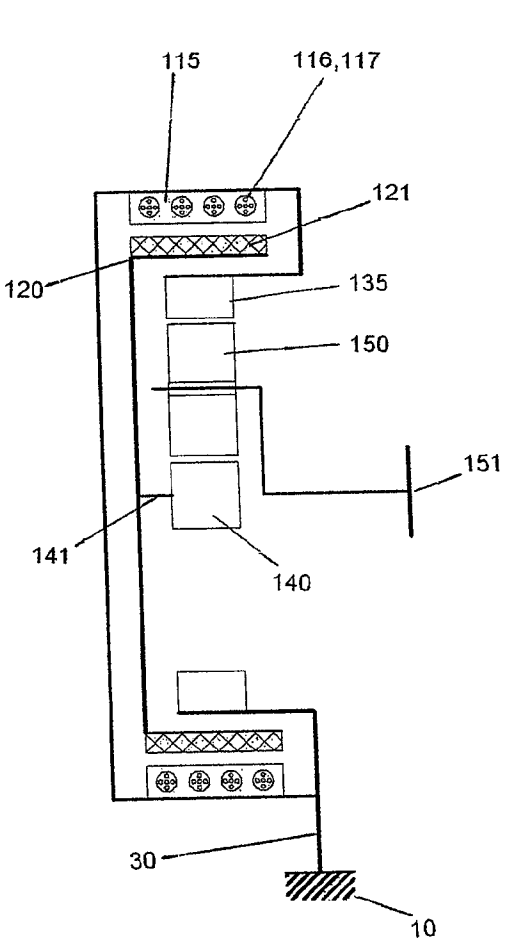
FIG. 2*a* is a diagrammatic view in cross-section showing the principle of a drive unit of a first embodiment of a comminuting apparatus according to the invention.
FIG. 2*b* shows a side view of the drive unit shown in FIG. 2*a*.
Figure 2:
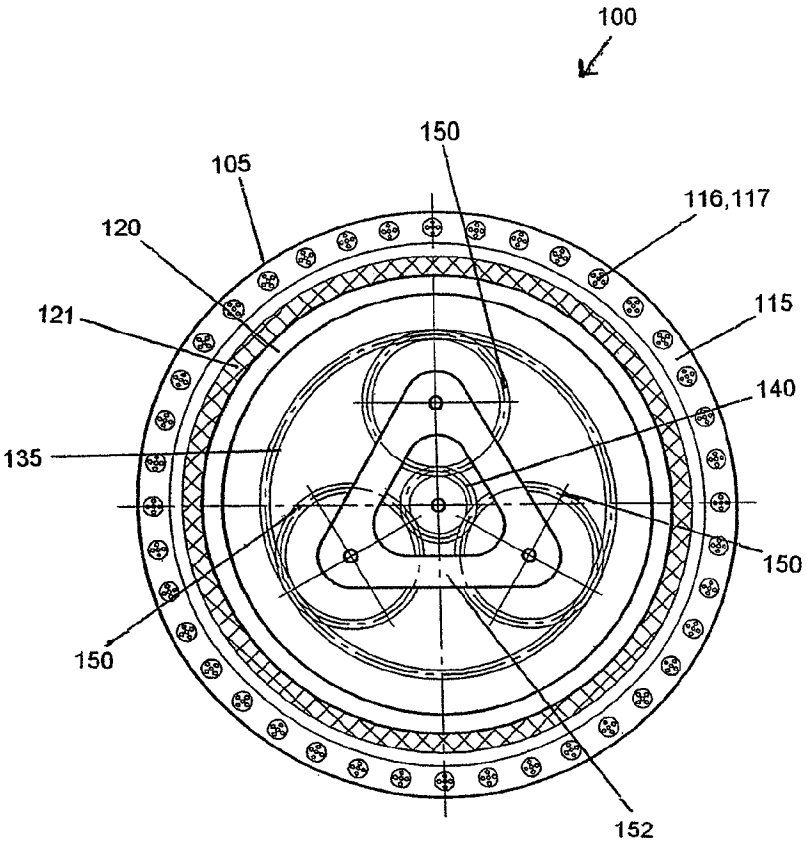

Reference will be made now to FIG. 2*a* as a plan view in diagrammatic form showing the principle of the drive unit while FIG. 2*b* is a side view. An essential component of the drive unit 100 is a stator 115 of a three-phase synchronous motor, which surrounds a motor winding 116 and a lamination plate packets 117. Arranged radially inwardly is a rotor 120 which is substantially rotationally symmetrical like the stator and which has permanent magnets 121 on its side which is towards the stator. Arranged inwardly relative to the stator 120 and completely covered in the axial direction by the stator is a planetary transmission device, the component parts of which are illustrated by symbols in FIGS. 2*a* and *b*. Placed radially adjacent to the rotor 120 is the transmission annulus 135 which as stated is connected to the stator of the synchronous motor. As also shown in FIG. 2*b* the rotor 120 of the electric motor is connected rigidly to a sun wheel shaft 141 which carries a sun wheel 140. In the illustrated embodiment the planetary transmission device comprises three planet wheels 150 which are carried by a planet wheel carrier 152. The transmission drive output shaft is afforded by a planet wheel carrier shaft 151 to which the machine shaft is coupled (see FIG. 1). The housing of the drive unit and the stator 115 are connected by way of a torque support 30 to the housing 10 of the apparatus.

Figure 3:
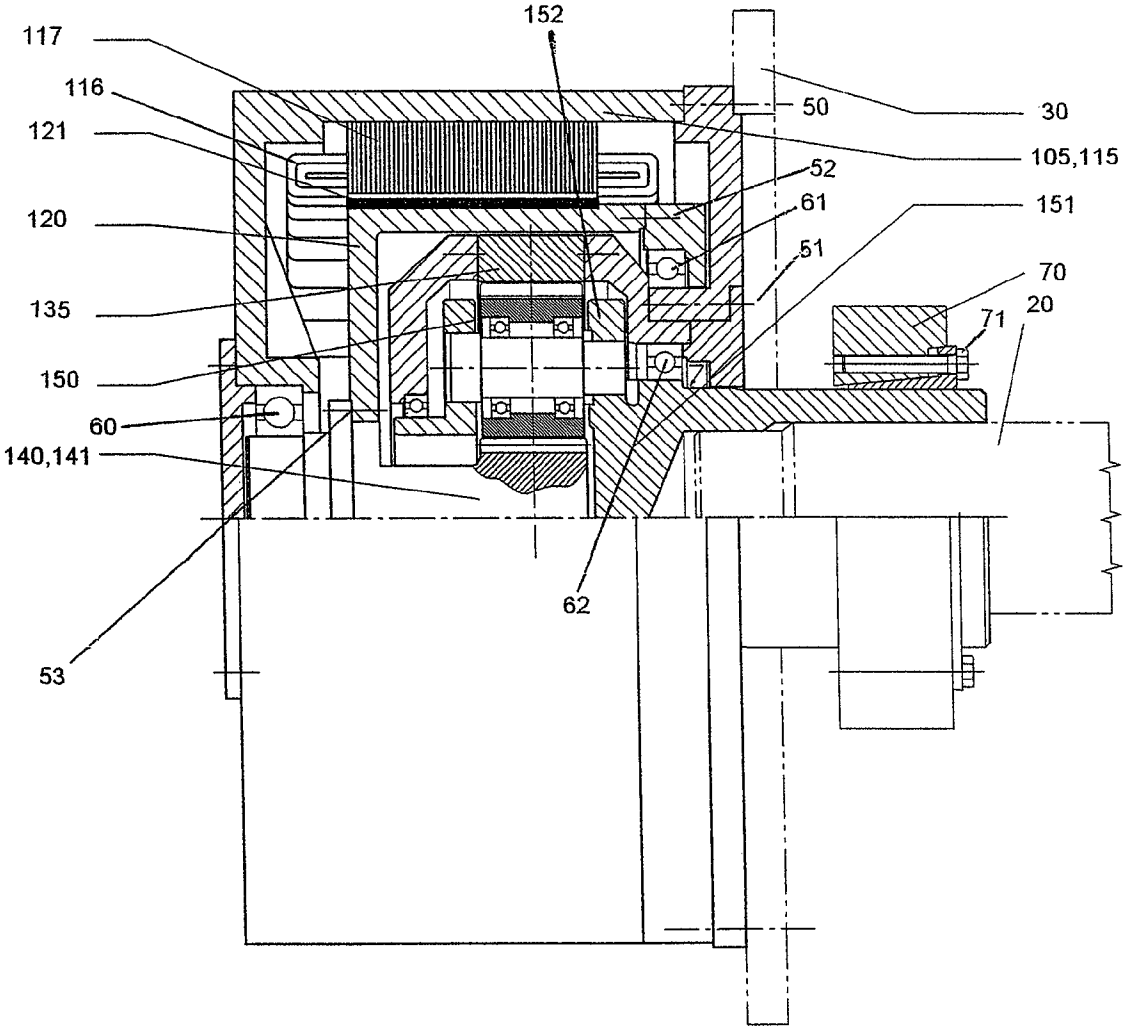
FIG. 3 is a half-sectional view of the drive unit shown in FIGS. 2*a* and *b*.

FIG. 3 is a half-sectional view showing in greater detail the drive unit illustrated by means of symbols in FIGS. 2*a* and 2*b*, wherein the same references have been used for the same components. As is clearly apparent from the Figure the annulus 135 is rigidly connected by way of screw connections 51, 50 to the housing 10 and the stator 115 respectively. The drive housing is supported on the housing of the comminuting apparatus by way of the torque support 30, see FIGS. 1*a* and *b*. The permanent magnets 121 mounted radially outwardly on the rotor 120 cooperate with the rotary field of the motor winding for synchronous rotation of the rotor with the field. The rotor is connected by way of a screw connection 53 to the sun wheel 140 of the planetary transmission device, with the sun wheel being supported on the housing 10 by way of a bearing 60. The rotor 120 is supported in a similar manner with respect to the stationary annulus 135 by means of a bearing 61. The planet wheel carrier shaft 151 is extended outwardly in the form of the transmission drive output shaft out of the housing 10 in the form of a hollow shaft. As illustrated in the drawing the machine shaft 20, that is to say the comminuting shaft, is inserted into the transmission drive output hollow shaft and fixed by means of a contraction assembly 70. The contraction assembly has a ring which externally embraces the hollow shaft 151 and in which is arranged an oppositely tapering sleeve which is braced in the axial direction by screws 71 and thereby produces a radial pressing force in the direction of the shaft 151. The drive is supported or carried directly by the machine shaft 20. Transmission of the torque between the drive output hollow shaft 151, that is to say the planet wheel carrier shaft, and the machine shaft 20 is effected depending on the respective embodiment involved either in frictionally locking relationship by the high pressures produced by the contraction assembly 70 or in positively locking relationship, for example by an internal-external tooth arrangement in a mutually engaging condition on the shafts 20 and 151. In the latter case the contraction assembly 70 serves to eliminate the play required for assembly purposes between the hollow shaft 151 and the machine shaft 20, in operation of the apparatus. It will be appreciated that it is also possible to use other connections between the drive output shaft 151 of the planetary transmission device and the comminuting shaft 20.

Based on the comminuting apparatus according to the invention which is shown in FIG. 1*a*, in a further embodiment it is provided that a drive unit as described with reference to FIG. 3 is also to be coupled to the second end of the comminuting shaft 20, whereby the torque provided for comminution can be doubled without the rotary speed having to be reduced. In addition it is in accordance with the invention to provide a plurality of comminuting shafts in a comminuting apparatus, in which case a drive unit is coupled to at least one thereof, with a high-pole three-phase synchronous motor, which can be referred to as a torque motor, which disposed at a radially inward position encloses at least a part of an epicyclic transmission device, in particular a part of a single-stage planetary transmission device.

Figure 4:
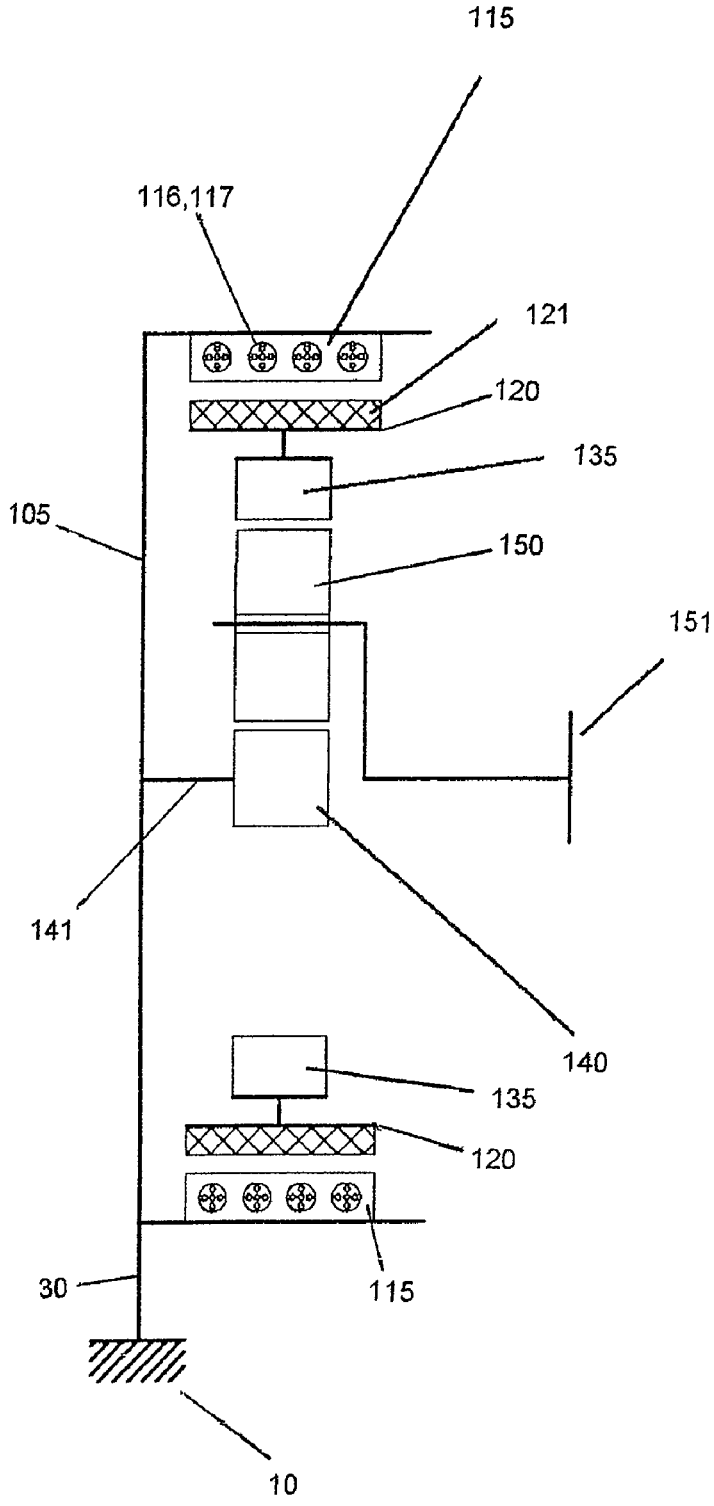
FIG. 4 is a diagrammatic view showing the principle of an alternative drive unit for the comminuting apparatus according to the invention.

In a further embodiment of the invention the planetary transmission device which is enclosed by the synchronous motor can be arranged in such a way that the sun wheel 140 or the sun wheel shaft 141 is connected to the stator 115 or the transmission housing, see FIG. 4. In the drive unit of a further embodiment of the comminuting apparatus according to the invention, shown by means of symbols in FIG. 4, the sun wheel shaft 141 is fixedly connected to the housing 10, for example by way of a torque support 30 as described hereinbefore. Once again the planet wheel carrier shaft 151 serves as the transmission drive output shaft, that is to say for fixing to the comminuting shaft (not shown). In contrast to the drive unit shown in FIG. 2*b* in this case the transmission annulus 135 of the planetary transmission device moves with the rotor 120, that is to say the rotor member of the synchronous motor. The annulus 135 is accordingly rigidly connected to the magnet arrangement of the rotor and moves with same. As the rotor is integrated with the annulus or is in the form of an interrelated component, that affords advantages in terms of the number of components and the necessary separation or mounting locations.

It will be appreciated that the above-described embodiments of the comminuting apparatus and the drive unit for same have been set forth solely by way of example and illustration of the invention and that various other alterations and modifications may be made therein without thereby departing from the spirit and scope of the invention.

What is claimed is:

1. A comminuting apparatus for waste comprising a comminuting shaft, comminuting tools at the periphery of the comminuting shaft, a counterpart member cooperable with the tools for comminuting the material to be processed, at least one drive unit having an electric motor in the form of a high-pole three-phase synchronous motor, a frequency converter having an output electrically connected to the motor, a control device operable to control the frequency converter, a transmission device in the form of an epicyclic transmission device connecting the drive unit to the comminuting shaft, wherein the motor surrounds the epicyclic transmission device at least in part, and a common housing enclosing the motor and the transmission device.

2. A comminuting apparatus as set forth in claim 1, wherein the epicyclic transmission device includes at least a sun wheel, an annulus and a plurality of planet wheels.

3. A comminuting apparatus as set forth in claim 1, wherein the epicyclic transmission device has an arm carrier shaft projecting out of the common housing to provide a drive output shaft that is coupled to the comminuting shaft.

4. A comminuting apparatus as set forth in claim 2, wherein the axis of at least one of the sun wheel and the annulus lies on the axis of the motor.

5. A comminuting apparatus as set forth in claim 2, wherein the motor has radially outwardly disposed motor windings and the sun wheel is covered at least in portionwise relationship over the axial extent thereof by said windings.

6. A comminuting apparatus as set forth in claim 2, wherein the motor has radially outwardly disposed motor windings and the annulus is covered at least in portionwise relationship over the axial extent thereof by said windings.

7. A comminuting apparatus as set forth in claim 3, wherein the arm carrier shaft is in the form of a hollow shaft.

8. A comminuting apparatus as set forth in claim 1, wherein both the motor and the epicyclic transmission device include a coolant circuit, and wherein the two coolant circuits are coupled together, and further including a common heat exchanger for the two circuits.

9. A comminuting apparatus as set forth in claim 8, wherein the epicyclic transmission device has lubricating oil which serves as coolant for the coupled coolant circuits.

10. A comminuting apparatus as set forth in claim 1, further comprising a component in the form of a hollow cylinder having a radial outside surface and a radial inside surface, said component having a magnet arrangement of the motor at the radial outside surface, and wherein at least one gear device of the epicyclic transmission device is arranged at the radial inside surface.

11. A comminuting apparatus as set forth in claim 2, including means rigidly coupling the rotor of the motor to the sun wheel.

12. A comminuting apparatus as set forth in claim 2, including a coupling device coupling the rotor of the motor to the sun wheel.

13. A comminuting apparatus as set forth in claim 2, including means rigidly interconnecting the stator of the motor, the common housing and the annulus of the epicyclic transmission device.

14. A comminuting apparatus as set forth in claim 1, wherein the epicyclic transmission device is of a one-stage configuration with a step-down ratio of between 1:2 and 1:10.

15. A comminuting apparatus as set forth in claim 1, wherein the drive unit comprising the three-phase synchronous motor and the epicyclic transmission device is supported and carried completely by the comminuting shaft.

16. A comminuting apparatus as set forth in claim 12, including a torque support connecting the drive unit including the three-phase synchronous motor and the epicyclic transmission device to an external mounting point for absorbing reaction torque during operation of the apparatus.

* * * * *

UNITED STATES PATENT AND TRADEMARK OFFICE

CERTIFICATE OF CORRECTION

PATENT NO. : 7,469,850 B2
APPLICATION NO. : 11/461076
DATED : December 30, 2008
INVENTOR(S) : Wolfgang et al.

It is certified that error appears in the above-identified patent and that said Letters Patent is hereby corrected as shown below:

Face page of the patent Item (73), the assignee name should be

(73) Assignee: VECOPLAN AG

Signed and Sealed this

Eighth Day of September, 2009

David J. Kappos

David J. Kappos
*Director of the United States Patent and Trademark Office*